US007765908B1

(12) United States Patent
Hearn

(10) Patent No.: US 7,765,908 B1
(45) Date of Patent: Aug. 3, 2010

(54) DOUBLE-CUT FOLDER WITH COMBINATION CUT AND NIP CYLINDER

(75) Inventor: Michael Lee Hearn, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 1707 days.

(21) Appl. No.: 09/533,685

(22) Filed: Mar. 23, 2000

(51) Int. Cl.
*B26D 1/36* (2006.01)

(52) U.S. Cl. ..... 83/347; 83/344; 83/678

(58) Field of Classification Search ..... 83/118, 83/344, 346, 347, 348, 659, 678
See application file for complete search history.

(56) References Cited

U.S. PATENT DOCUMENTS

| | | | | | |
|---|---|---|---|---|---|
| 2,261,315 | A | * | 11/1941 | Thorsen | 83/345 X |
| 2,951,410 | A | * | 9/1960 | Brown | 83/304 |
| 3,119,312 | A | * | 1/1964 | Henc | 83/333 |
| 3,522,762 | A | * | 8/1970 | Sauer | 83/678 X |
| 3,686,988 | A | * | 8/1972 | Ross | 83/347 X |
| 3,866,497 | A | * | 2/1975 | Wolfberg et al. | 83/346 X |
| 3,921,481 | A | * | 11/1975 | Marcus | 83/117 |
| 3,954,034 | A | * | 5/1976 | Broderick | 83/678 X |
| 4,142,431 | A | * | 3/1979 | Jespersen | 83/335 |
| 4,249,441 | A | * | 2/1981 | Sturtz | 83/347 |
| 4,406,196 | A | * | 9/1983 | Roncato et al. | 83/117 |
| 4,444,080 | A | * | 4/1984 | Schulz | 83/678 X |
| 4,825,739 | A | * | 5/1989 | Pfaff | 83/139 |
| 4,925,521 | A | * | 5/1990 | Asbury et al. | 156/517 |
| 4,957,280 | A | | 9/1990 | Motooka | 270/47 |
| 4,983,155 | A | | 1/1991 | Stobb | 493/369 |
| 5,103,703 | A | | 4/1992 | Littleton | 83/155 |
| 5,107,733 | A | * | 4/1992 | Palmatier et al. | 83/678 X |
| 5,133,235 | A | * | 7/1992 | DeVito | 83/347 |
| 5,230,268 | A | | 7/1993 | Richter | 83/303 |
| 5,359,914 | A | * | 11/1994 | Brown | 83/139 |
| 5,740,709 | A | | 4/1998 | Boston et al. | 83/308 |
| 5,967,512 | A | * | 10/1999 | Irsik | 271/273 |
| 6,418,827 | B1 | * | 7/2002 | Bussey et al. | 83/304 |
| 6,435,069 | B1 | * | 8/2002 | Kirkpatrick et al. | 83/698.42 |
| 6,460,439 | B2 | * | 10/2002 | Belanger | 83/678 X |
| 6,718,855 | B2 | * | 4/2004 | Kane | 83/50 |

FOREIGN PATENT DOCUMENTS

| | | |
|---|---|---|
| DE | 19927920 | 2/2000 |
| EP | 0449006 | 10/1991 |

* cited by examiner

*Primary Examiner*—Kenneth E. Peterson
(74) *Attorney, Agent, or Firm*—Davidson, Davidson & Kappel, LLC

(57) ABSTRACT

A folder for a web printing press includes a first cutting and nipping device for partially cutting a web so as to form first cuts in the web and for nipping the web. A second cutting and nipping device cuts the web between the first cuts so as to form signatures, the web being nipped at a nip of the second cutting device. Also disclosed is a method for cutting a web which comprises the steps of partially cutting the web so as to form first cuts in the web while web is nipped; and cutting the web between the first cuts of the web while the web is nipped.

9 Claims, 4 Drawing Sheets

DOUBLE-CUT FOLDER WITH COMBINATION CUT AND NIP CYLINDER

BACKGROUND OF THE INVENTION

1. Field of the Invention

The present invention relates generally to web printing presses and more particularly to a folder for cutting a web into signatures.

2. Background Information

Web printing presses print a continuous web of material, such as paper. The continuous web then is cut in a cutting unit of a folder so as to form signatures which can then be folded or output.

U.S. Pat. No. 5,740,709 discloses a double-cut folder. The cutting cylinders do not provide a nipping action. This device is disadvantageous in that signatures may experience a stepped cut due to motion between the first and second cut.

U.S. Pat. No. 4,957,280 discloses a folder in which a web is first cut by a cutter drum, and then is pinched between a folding drum and conveyor belts. The web not cut by the first cutter drum is then cut by saw-tooth cutter blades of a second cutter device disposed on the folder drum so as to form a cut sheet. A head end of the web cut into the sheet is pushed into gaps between a plurality of clamping claws and claw seats and clamped.

The '280 patent has the disadvantages that slip may still occur in both the web direction and in a cross-web direction owing to the fact that the nip forces between the conveyor belts and the folding drum may not be sufficient. A stepped cut thus also may occur. Cut accuracy may also suffer due to a radius effect when variable thicknesses of web pass through the folder. Moreover, the '280 patent appears to require a complicated jaw-type device to maintain proper signature control. In addition, the anvil surfaces or cutter receiver may wear out over time.

Commonly-owned U.S. patent application Ser. No. 09/435,667 filed Nov. 8, 1999 (which is not necessarily prior art to the present invention) discloses a double-cut lobed belt diverter. A first cut is made with a first cutting cylinder and then a second cut by a second cutting cylinder having cutting disks. Lobed belts pass between the cutting disks to grab the cut signatures and divert the signatures into two streams. The belts grasps the lead of the signature after the second cut and thus do not help to maintain signature control during the second cut.

BRIEF SUMMARY OF THE INVENTION

An object of the present invention is to provide a device and method for reliably cutting signatures in a controlled fashion and to improve accuracy with regard to a "cut-to cut" measurement as well as print-to-cut measurement.

The present invention provides a folder having a first cutting and nipping device for partially cutting a web so as to form first cuts in the web and for nipping the web, and a second cutting and nipping device for cutting the web between the first cuts so as to form signatures and for nipping the web.

By having the web nipped between the first and second cutting devices, cut accuracy, both for cut-to-cut and print-to-cut, can be maintained at all times.

The first cutting and nipping device includes a first cutting cylinder having a nipping surface and at least one segmented cutting element having axially-spaced cutting surfaces. The nipping surface extends circumferentially between the cutting surfaces. The first cutting and nipping device also includes an anvil cylinder for forming a nip with the nipping surface and an anvil for the segmented cutting element.

The second cutting and nipping device includes a cutting cylinder having a nipping surface and at least one segmented cutting element having axially-spaced cutting surfaces. The nipping surface extends circumferentially between the cutting surfaces. An anvil cylinder forms a nip with the nipping elements and an anvil for the segmented cutting element.

The folder preferably includes a plurality of first belts and a plurality of second belts, the web being held by the first belts and second belts at the first cuts. At least one of the anvil cylinder and the cutting cylinder of the second cutting and nipping device have axially-spaced grooves between the nipping surfaces of the second cutting an nipping device, the belts passing through the grooves.

Preferably, the nipping elements and the anvil cylinder include a urethane outer coating. The urethane provides an excellent anvil and nipping surface. However, nipping surface materials other than urethane are possible.

Preferably, the cutting cylinder includes a metallic hub with the at least one segmented cutting element bolted to the hub. Urethane or another nipping material bonded to the hub then forms the rest of the cutting cylinder. The anvil cylinder also may have a metal core with a urethane or other nipping material outer surface bonded to the core.

The cutting cylinder preferably has two segmented cutting elements spaced 180 degrees apart.

The anvil cylinder preferably is indexable circumferentially so that a new anvil surface may be provided. A continuous outer layer, preferably of urethane, on the anvil cylinder is thus highly advantageous so that a new anvil surface can be presented when the anvil cylinder is indexed with respect to the cutting cylinder. The anvil cylinder thus can be operational for a longer period than traditional anvil cylinder having a specifically designed anvil area.

The center distance between the cutting cylinder and the anvil cylinder of the cutting and nipping devices preferably is adjustable to adjust the nipping function, for example to accommodate different web thicknesses. The adjustment preferably is force-loaded, for example by springs, so that the devices automatically compensates the center distance if the thickness of the material changes.

The cutting and the anvil cylinders preferably are cantilevered, to permit easy replacement of the belts.

The present invention also provides a method for cutting a web which includes the steps of partially cutting the web so as to form first cuts in the web and nipping the web as the first cuts are formed; and cutting the web between the first cuts while the web is nipped.

The present method advantageously provides a double-cut configuration which can allow for holding of web during the first and second cuts in a firm nipped position. Tension and proper placement may be maintained during the cut operation.

The present device and method is particularly advantageous for use with high-speed web printing presses, e.g. presses operating at over 2000 feet per minute, since the web and resultant signatures may be held firmly even at high speed due to the nips at the first and second cutting devices. The web and the knives thus track exactly together.

BRIEF DESCRIPTION OF THE DRAWINGS

A preferred embodiment of the present invention is described below by reference to the following drawings, in which.

DETAILED DESCRIPTION

Figure 1:
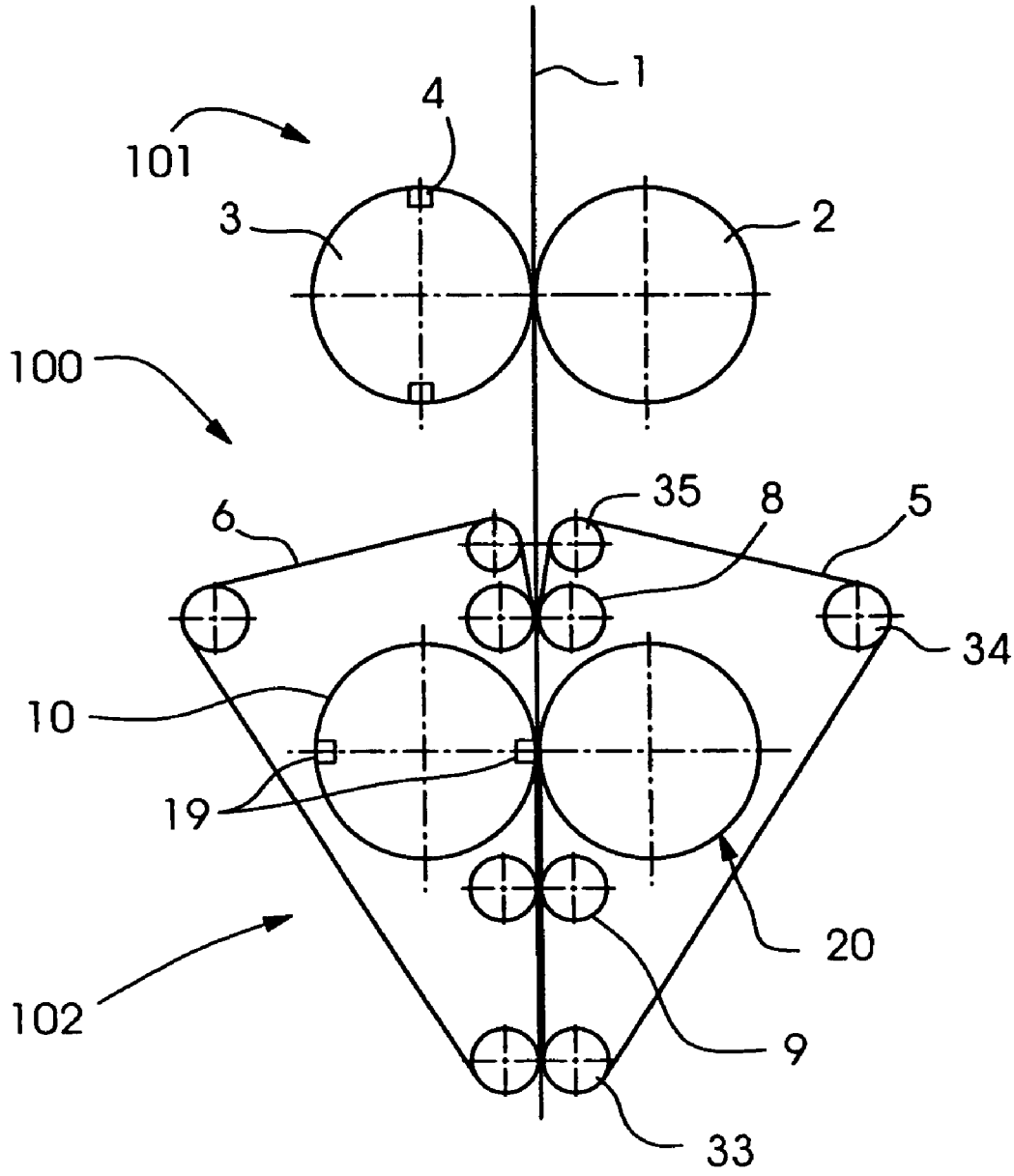
FIG. 1 shows a side view of the folder of an offset web printing press according to the present invention.
Figure 4:
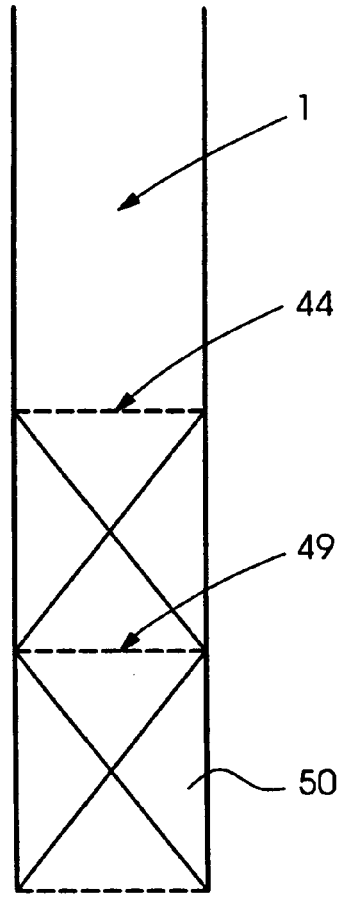
FIG. 4 shows a representation of the web and a resultant signature produced by the folder of FIG. 1.

FIG. 1 shows a folder 100 having a first cutting and nipping device 101 for partially cutting a web 1 to form first cuts 44 in web 1, as shown in FIG. 4. First cutting and nipping device 101 has a cutting cylinder 3 with a segmented cutting blade 4. Segmented cutting blade 4 has spaced apart blade edges for cutting spaced-apart cuts in web 1, but not for severing the entire width of web 1. The segmented cutting blades 4 work against an anvil cylinder 2 of first cutting device 101. Cutting cylinder 3 and anvil cylinder 2 also nip web 1 about the segmented blade 4.

Figure 3:
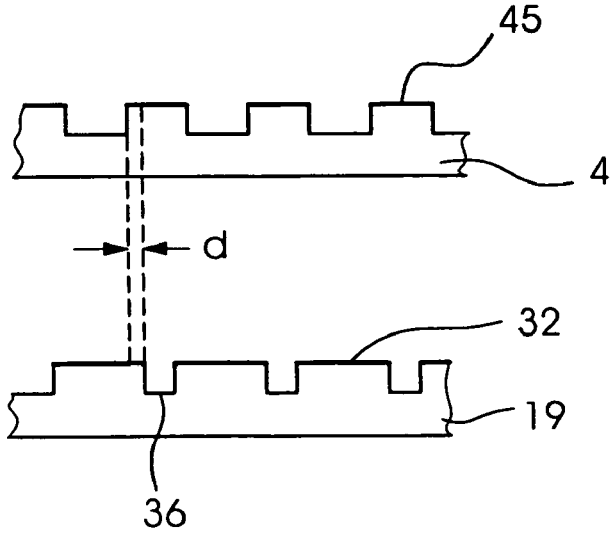
FIG. 3 shows a representation of a segmented cutting element on the first cutting device as located axially with respect to a cutting element of the second cutting device shown in FIG. 1.
Figure 5:
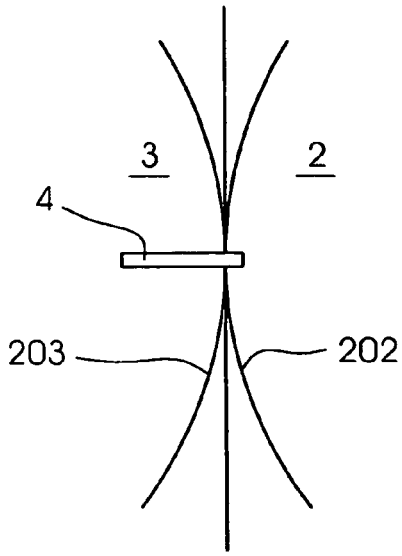
FIG. 5 shows the nipping and cutting action of a cutting and nipping device of the FIG. 1 folder.

FIG. 5 shows the nipping and cutting action of the cutting cylinder 3 and anvil cylinder 2. Nipping surface 202 of anvil cylinder 2 extends circumferentially about the anvil cylinder, and may be for example a continuous outer layer of material, such as urethane. Nipping surface 203 of cutting cylinder 3 extends circumferentially with respect to blade 4, which has axially spaced blade edges 45 as shown in FIG. 3. Blade 4 thus forms partial first cuts in the web 1, and the web 1 remains nipped by nipping surfaces 202, 203 as web 1 travels past the first cutting and nipping device 101.

Web 1 after being partially cut by first cutting device 101 passes between first guide belts or tapes 5 and second guide belts or tapes 6. Each of belts 5 and 6 include a plurality of belts spaced apart in the axial direction of cutting cylinder 3 (i.e. into the page in FIG. 1). The movement of first belts 5 is defined by guide rollers 8, 9, 33, 34, 35. At least one of the guide rollers may be driven by a motor to drive the belts 5, although alternatively the belts may be driven by the nipping action of the second cutting device 102. Rollers 8 and 9 may be nip rollers for passing the belts 5, the web 1 and belts 6 through a nip with corresponding guide rollers for belts 6. Belts 6 may have a similar guide roller arrangement.

Figure 6:
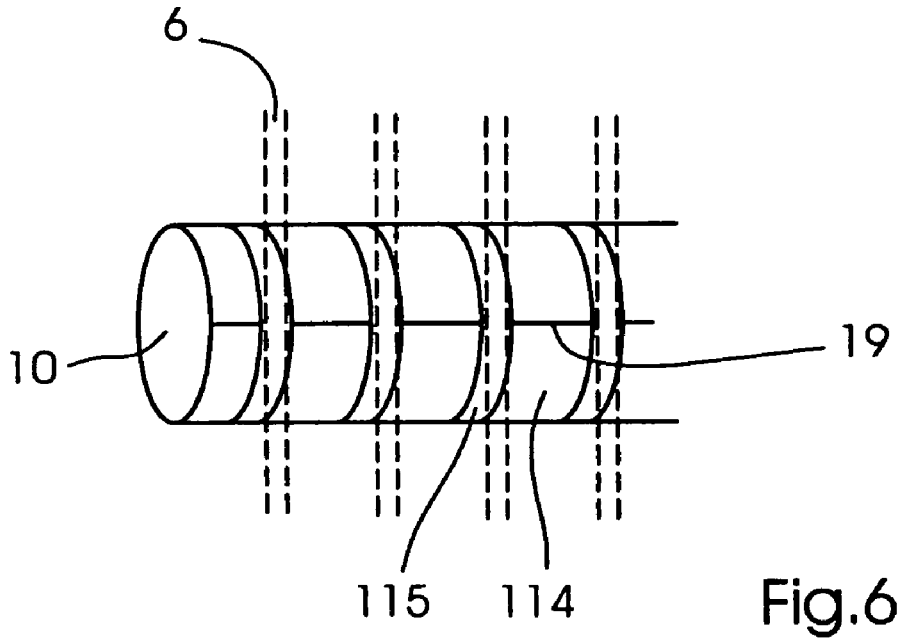
FIG. 6 shows belts passing through axially-spaced grooves in the cutting cylinder of the second cutting and nipping device.
Figure 7:
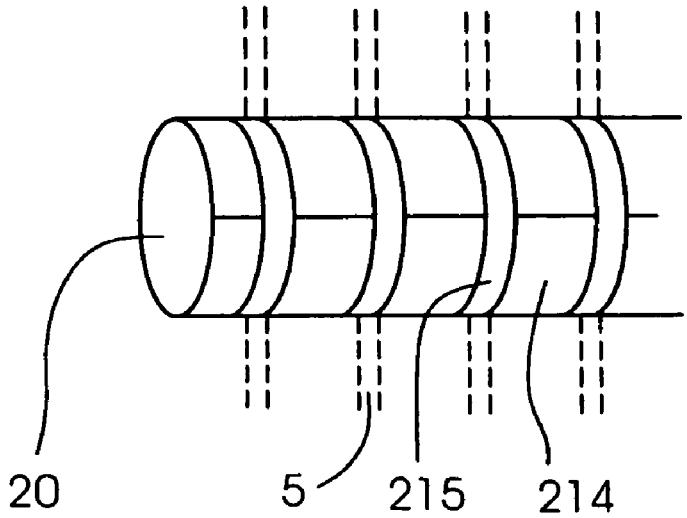
FIG. 7 shows belts passing through axially-spaced grooves in the anvil cylinder of the second cutting and nipping device.

Web 1 then is guided by belts 5, 6 to second cutting and nipping device 102 having a cutting cylinder 10 and an anvil cylinder 20. Cutting cylinder 10 has segmented blades 19 which cuts web 1 between first cuts 44 to make a full cut 49, as shown in FIG. 4, thereby forming a signature 50. Belts 5, 6 pass between cutting edges 32 (FIG. 3) of the segmented blades 19 and are passed along with the web between the outer surfaces of the cutting cylinder 10 and anvil cylinder 20. As shown in FIG. 6, belts 6 preferably pass though axially spaced grooves 115 in cutting cylinder 10, so that they are not nipped. As web 1 passes though second cutting and nipping device 102, web 1 is nipped by nipping surface 114 of cutting cylinder 10 and nipping elements 214 of anvil cylinder 20 (FIG. 7). As shown in FIG. 7, belts 5 can pass through grooves 215 in anvil cylinder 20. Nipping surface 114 extends circumferentially with respect to blade edges 32 of blades 19 (FIG. 3). Nipping surface 214 preferably extends circumferentially about cylinder 20 in a continuous manner.

The linear position of the web in the direction of web travel and the cross web direction is controlled by the non-slip boundary condition between the nip and the web. This nipping action of second cutting and nipping device 102 permits a firm grip on web 1 as each segmented blade 19 cuts web 1 between first cuts 44 (FIG. 4). With the nipping action of the present invention, improved cut-to-cut accuracy with a double-cut folder is improved, as well as print-to-cut accuracy. Stepped cut problems which arise in other double cut designs can be eliminated or reduced.

After the second cut, signature 50 (FIG. 4) is then conveyed by belts 5, 6 to a next section in the folder.

Figure 2:
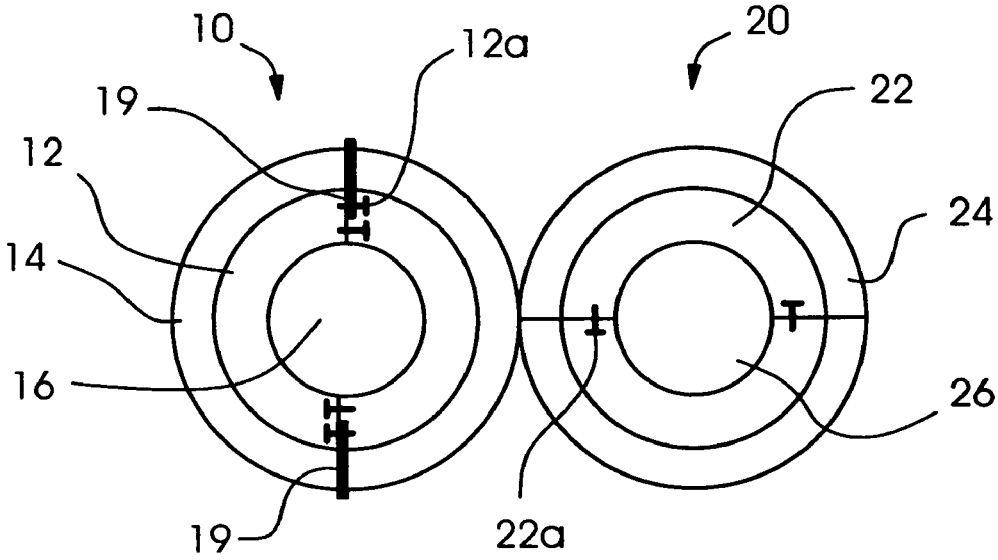
FIG. 2 shows a cutting and nipping device of the FIG. 1 folder in more detail.

FIG. 2 shows the cutting cylinder 10 and anvil cylinder 20 in more detail. Cutting cylinder 10 includes an axle 16 which may be connected to a motor to drive cylinder 10. About (axle 16 is a two-part hub 12, preferably metallic, which can be bolted together by bolts 12*a* as shown. Segmented cutting blades 19 fit between the two parts of hub 12 and may also be fastened by bolts 12*a* to hub 12.

A urethane or other nipping material outer layer 14 is placed over hub 12, either before or after the fastening of the two parts of hub 12 together. Layer 14 thus provides a continuous smooth surface extending circumferentially from the blade edges 32. Indented areas 36 (FIG. 3) of segmented blades 19, which can coincide with grooves in the layer 14, may present themselves directly at the surface of cylinder 10 or be covered by urethane or other material to reduce belt wear. Layer 14 may be pre-bonded to the parts of the hub before assembly. If not coated, the indented area 36 in such a case preferably is dull and meshes with the bottom surface of grooves 115 (FIG. 6) so as not to degrade the belts 6 which run in grooves 115. The belts may run at a different speed than the cylinders.

Anvil cylinder 20 includes an axle 26 which may be geared to the drive motor for cutting cylinder 10 to rotate at the same speed as cutting cylinder 10. An independent drive motor may also be provided. A metallic hub 22 can be bolted by bolts 22*a* and fastened around axle 26. A urethane or other nipping material layer 24 may be prebonded to each side of hub 22, or may be added over hub 22 once it is fastened about axle 26. Alternatively, hub 22 may be a single piece construction.

Anvil cylinder 12 (or cutting cylinder 10) preferably is indexable circumferentially so that a new anvil surface may be provided once a part of the anvil surface is worn down by the action of the blades 19. To provide the indexing, an harmonic drive may be provided.

The center distance between cutting cylinder 10 and anvil cylinder 20 is adjustable to adjust the nipping function, for example to accommodate different web thicknesses. A simple mechanical, pneumatic or hydraulic device (not shown) may be provided for this adjustment, or preferably a force-loaded automatic adjustment may occur.

Cutting cylinder 10 and anvil cylinder 20 are cantilevered, which permits easy replacement of the belts on the non-cantilevered side. A releasable bearing may be provided to support the second end.

Cutting cylinder 3 and anvil cylinder 2 may be similar in construction to cutting cylinder 10 and anvil cylinder 20, except that the nip surfaces of cutting cylinder 3 and anvil cylinder 2 do not need to accommodate any belts and are therefore preferably are continuous in an axial direction. The axial location of the cutting surfaces also alternate, as shown schematically in FIG. 3. Blades 4 have cutting edges 45 which cut first cuts 44 (FIG. 4). Blades 19 (FIG. 3) have cutting surfaces 32 which preferably overlap axially with cutting surfaces 45 as indicated by distance d. Belt 6 passes between cutting surfaces 32 over the area 36.

By providing cutting and nip surfaces on the same cutting cylinder, a more accurate cut may be achieved. The web may be held at all times so that more accurate signature and cut formation can result. The urethane coating is particularly advantageous for providing the nipping function with the present device.

Each of the first cuts has a particular length defined by the width of cutting edges 45 (FIG. 3). As defined herein, the first and second belts being "at" the first cuts is defined as the belts contacting the web on both sides perpendicular to the cut, but not necessarily over the entire length of the cut.

The cutting cylinders 3, 10 may have a plurality of blades, such as 2, 3 or 4 blades spaced 180 degrees, 120 degrees or 90 degrees apart, respectively.

"Nipping surface" as defined herein is a section of the cutting cylinder extending circumferentially with respect to the cutting surfaces of the segmented blades. The nipping surface forms a nip with an anvil cylinder so as to nip the web.

The bonding of the urethane or other nipping material may take place via an adhesive, for example.

What is claimed is:

1. A cutting and nipping device for cutting and nipping a web, comprising:

a first cutting cylinder having a first segmented cutting blade with axially spaced first blade edges and having first blade sides and a first cutting cylinder nipping surface extending circumferentially about the first cutting cylinder from the first blade sides; and a first anvil cylinder having a first anvil cylinder nipping surface extending circumferentially about the first anvil cylinder;

the first cutting cylinder nipping surface and the first anvil cylinder nipping surface providing a first nip for gripping the web about the first segmented cutting blade, the first blade edges extending radially beyond the first cutting cylinder nipping surface when the first blade edges are apart from the first anvil cylinder, a second cutting and nipping device for cutting and nipping the web, the second cutting and nipping device having:

a second cutting cylinder, the second cutting cylinder having a second segmented cutting blade with axially spaced second blade edges and a second cutting cylinder nipping surface extending circumferentially about the second cutting cylinder from the second blade edges; and a second anvil cylinder, the second anvil cylinder having a second anvil cylinder nipping surface extending circumferentially about the second anvil cylinder;

the second cutting cylinder nipping surface and the second anvil cylinder nipping surface providing a second nip for gripping the web about the second segmented cutting blade the second blade edges extending radially beyond the second cutting cylinder nipping surface when the second blade edges are apart from the second anvil cylinder, the segments of the first segmented cutting blade being axially offset from the segments of the second segmented cutting blade, such that the first segmented cutting blade makes a perforation cut in the web and the second segmented cutting blade converts the perforation cut into a full cut of the web.

2. The cutting and nipping device as recited in claim 1 wherein the first cutting cylinder nipping surface has a urethane outer coating.

3. The cutting and nipping device as recited in claim 1 wherein the first anvil cylinder nipping surface has a urethane outer coating.

4. The cutting and nipping device as recited in claim 3 wherein the urethane outer coating is continuous.

5. The cutting and nipping device as recited in claim 1 wherein the first cutting cylinder includes a two-part metallic hub.

6. The cutting and nipping device as recited in claim 5 wherein the first cutting cylinder nipping surface has a urethane outer coating, and wherein the urethane outer coating is bonded to the outer surface of the hub.

7. The cutting and nipping device as recited in claim 1 wherein the first anvil cylinder includes a two-part metallic hub.

8. The cutting and nipping device as recited in claim 7 wherein the first cutting cylinder nipping surface has a urethane outer coating, and wherein the urethane outer coating is bonded to the outer surface of the hub.

9. The cutting and nipping device as recited in claim 1 wherein the first cutting cylinder has a second segmented cutting blade spaced 180 degrees apart from the first segmented cutting blade.

* * * * *